US006991700B2

(12) United States Patent
Smith

(10) Patent No.: US 6,991,700 B2
(45) Date of Patent: Jan. 31, 2006

(54) HEAT SEALED WEBBING METHOD AND APPARATUS FOR POOL COVERS

(76) Inventor: Lanny R. Smith, 815 W. Blue Spruce Rd., Alpine, UT (US) 84004

( * ) Notice: Subject to any disclaimer, the term of this patent is extended or adjusted under 35 U.S.C. 154(b) by 0 days.

(21) Appl. No.: 10/305,467

(22) Filed: Nov. 26, 2002

(65) Prior Publication Data

US 2003/0097709 A1 May 29, 2003

Related U.S. Application Data

(60) Provisional application No. 60/334,094, filed on Nov. 29, 2001.

(51) Int. Cl.
*B32B 31/20* (2006.01)

(52) U.S. Cl. ..... 156/308.4; 4/498; 52/3

(58) Field of Classification Search ..... 4/498; 52/3; 156/157, 202, 203, 216–218, 227, 156/289, 304.1, 304.3, 308.2, 308.4, 324.4

See application file for complete search history.

(56) References Cited

U.S. PATENT DOCUMENTS

| | | | | |
|---|---|---|---|---|
| 3,978,191 | A * | 8/1976 | Allen et al. | 156/202 |
| 4,588,463 | A * | 5/1986 | Barber et al. | 156/227 |
| 4,628,549 | A * | 12/1986 | Lazar | 4/498 |
| 5,920,922 | A * | 7/1999 | Ragsdale et al. | 4/498 |
| 6,471,803 | B1 * | 10/2002 | Pelland et al. | 156/304.3 |
| 6,474,022 | B1 * | 11/2002 | Double et al. | 52/3 |

* cited by examiner

*Primary Examiner*—Tuan Nguyen
(74) *Attorney, Agent, or Firm*—Kulani Fisher; Rader, Fishman & Grauer PLLC

(57) ABSTRACT

A method is provided for attaching an elongated webbing member to an edge of a pool cover, comprising positioning the edge of the pool cover so that a portion of the pool cover edge is in contact with a portion of the webbing, and heat sealing the webbing portion to the pool cover edge portion. An assembly is provided for coupling a pool cover to a connector mechanism attached to a pool, comprising a pool cover comprising at least one pool cover edge, and a webbing coupled to at least a portion of the pool cover edge by a heat seal between a portion of the webbing and a portion of the pool cover edge. An apparatus is also provided for forming a webbing attached to the edge of a pool cover.

23 Claims, 8 Drawing Sheets

HEAT SEALED WEBBING METHOD AND APPARATUS FOR POOL COVERS

RELATED APPLICATION

This application claims the priority of provisional application No. 60/334,094, filed Nov. 29, 2001.

BACKGROUND

1. Field

The present disclosure relates to swimming pool covers, and, more particularly, to a method and apparatus for attaching webbing to the edges of pool covers.

2. Background

Swimming pools are commonly covered to prevent debris from entering the pool, to preserve chemical treatments in the water and to heat the pool in the case of a solar cover. Typically, a pool cover will extend over the entire surface of the pool during periods of non-use and then be retracted during periods of use. The cover may be extended and retracted by mechanical or automatic means. In either case, a track assembly is usually connected to or built into the walls for guiding the edges of the cover as it traverses the pool. The pool cover typically has some means connected along the edge of the cover interacting with the track assembly to facilitate movement of the pool cover.

The pool cover may be fabricated from a vinyl-coated mesh made up of a dacron thread or "skrim" covered on top and bottom by vinyl coating. The result is a strong, durable and waterproof material that is ideal for long-term, maintenance-free use. The webbing may be made out of canvas or sail cloth, so that it can endure the mechanical stresses and wear placed on it as the bead slides along the tracking assembly and as weight is placed on the cover.

The webbing may be connected to the pool cover by thread stitches running along the webbing. Although the stitches are made of strong and durable thread, they are vulnerable to wear and may eventually wear out before the cover or the webbing. This wear occurs as the result of several factors, including ultraviolet rays from sunlight, chemical corrosion from pool chemicals and the mechanical stresses described above. Accordingly, it is not unusual for periodic repairs to be required to the thread stitching in order to maintain the integrity of the connection between the webbing and the pool cover.

Accordingly, there is an important need for an improved connection between the pool cover and the webbing that forms the edge bead for the pool cover. An improved webbing material and method of attaching the material to the pool cover is needed to reduce maintenance on the pool cover and to increase safety and durability for the pool cover.

SUMMARY

The present disclosure provides an improved method for attaching border webbing to an edge of the pool cover to form a bead for guiding the webbing along an encapsulated track. The border webbing is heat sealed to the edge of the pool cover to form a durable attachment thereto. The webbing and the edge of the pool cover are made of heat sensitive material that become plastic and form a bond with the application of heat.

One application of the disclosure comprises a method for attaching an elongated webbing member to an edge of a pool cover, wherein the edge of the pool cover is positioned so that a portion of the pool cover edge is in contact with a portion of the webbing. The portion of the pool cover edge is then heat sealed to the portion of the webbing.

The method further comprises wrapping the webbing around an elongated filler member, so that at least one flap extends from the filler member, positioning the portion of the pool cover edge to overlap the flap, and applying heat to cause a heat seal between the portion of the pool cover edge and the flap. Preferably, the portion of the pool cover edge and/or the flap are composed of a heat sensitive material that will form the heat seal.

Another application comprises a pool cover having at least one pool cover edge, a webbing coupled to at least a portion of the pool cover edge by a heat seal between a portion of the webbing and a portion of the pool cover edge.

Additionally, the portion of the webbing and/or the portion of the pool cover edge may be made of a thermoactive material, such as vinyl, that becomes plastic with the application of heat, to form the heat seal. As used herein, the term "thermoactive material" means a material that is sufficiently sensitive to heat to become pliable or plastic in consistency, so as to provide a surface appropriate for heat welding. The webbing may be wrapped around a filler element to form a bead, so that the bead substantially maintains its shape under mechanical stress to guide the edge of the pool cover along a mechanical track.

Another implementation includes an apparatus for forming a webbing attached to the edge of a pool cover, comprising a positioning element for disposing a portion of the webbing in contact with a portion of the pool cover edge and a heating element for applying heat to form a heat seal between the webbing portion and the pool cover edge portion.

Additional optional features include a pressing element for consolidating the heat seal between the webbing portion and the pool edge cover portion. The positioning element may provide a flap extending from the webbing to overlap the portion of the pool cover edge and form the heat seal therewith. The apparatus may further comprise an element for wrapping the webbing around an elongated filler element, wherein the wrapping element forms the portion of the webbing to include at least one flap extending from the filler element. The portion of the pool cover edge may extend between first and second flaps of the webbing. The heating element may include a first nozzle to apply heat to the first flap and a second nozzle to apply heat to the second flap.

BRIEF DESCRIPTION OF THE DRAWINGS

The above-mentioned and other features and advantages of this disclosure, and the manner of attaining them, will become more apparent and the disclosure will be better understood by reference to the following description of an example taken in conjunction with the accompanying drawings, wherein.

Corresponding reference characters indicate corresponding parts throughout the several views. The exemplification set out herein illustrates one example, in one form, and such exemplification is not to be construed as limiting the scope of the disclosure in any manner.

DETAILED DESCRIPTION

Figure 1:
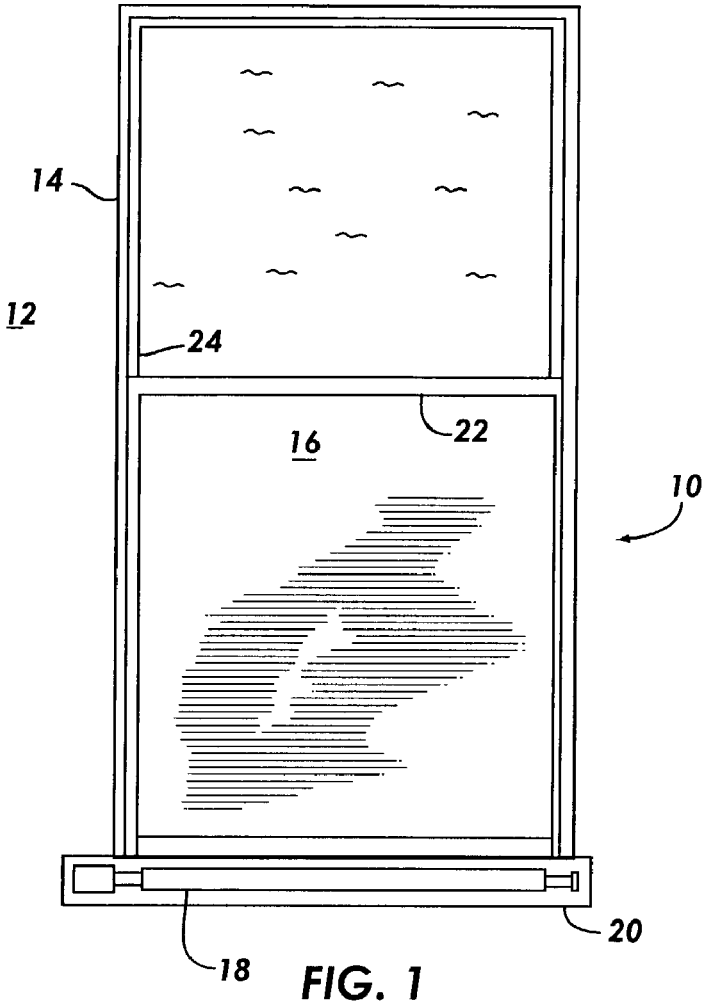
FIG. 1 is a plan view of a pool showing a pool cover guided by a tracking assembly in the pool walls.

In FIG. 1, a rectangular swimming pool 10 is shown having a pool deck 12 and coping 14 surrounding the pool. An automatic pool cover 16 extends from a pool cover mechanism 18 in a cover assembly box 20 disposed at one end of the pool. A leading edge bar 22 at the front edge of the pool cover 16 rides in a track assembly 24 along the interior walls of the pool. Deck 12 is generally horizontal and is preferably constructed from concrete. Coping 14 connects to deck 12 in a substantially coplanar fashion along the edge of deck 12 facing the interior of swimming pool 10. Track assembly 24 may be of any suitable structure to retain the edge of the pool cover as it slides in the track.

Figure 2:
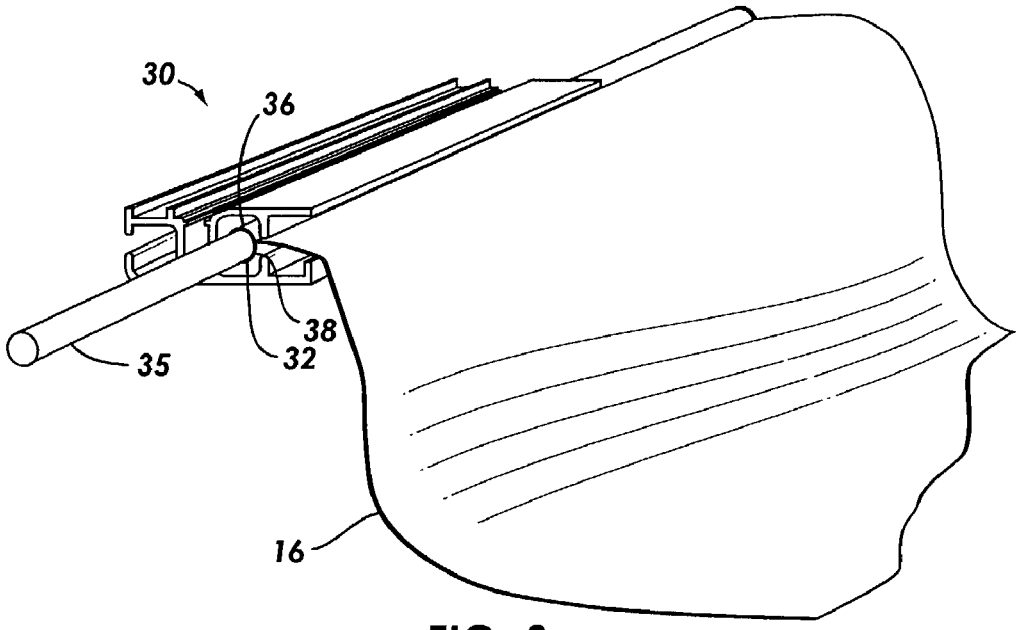
FIG. 2 is a perspective view of a prior art structure showing a webbing and bead formed along the edge of the pool cover and carried in the tracking assembly.

FIG. 2 shows an encapsulation track assembly 30 having an elongated chamber 32 therein. The pool cover 16 is connected along its edge to an elongated bead 36 comprised of a wrapped rope or filler 35 that is captured in chamber 32. The pool cover 16 extends out through a slot 38 in chamber 32. Chamber 32 is sufficiently large to allow the bead 36 to slip therethrough as the cover 16 moves. Likewise, slot 38 is ample in width to allow the pool cover edge to move easily along the slot, but is small enough to restrain the bead 36 within chamber 32.

Figure 3:
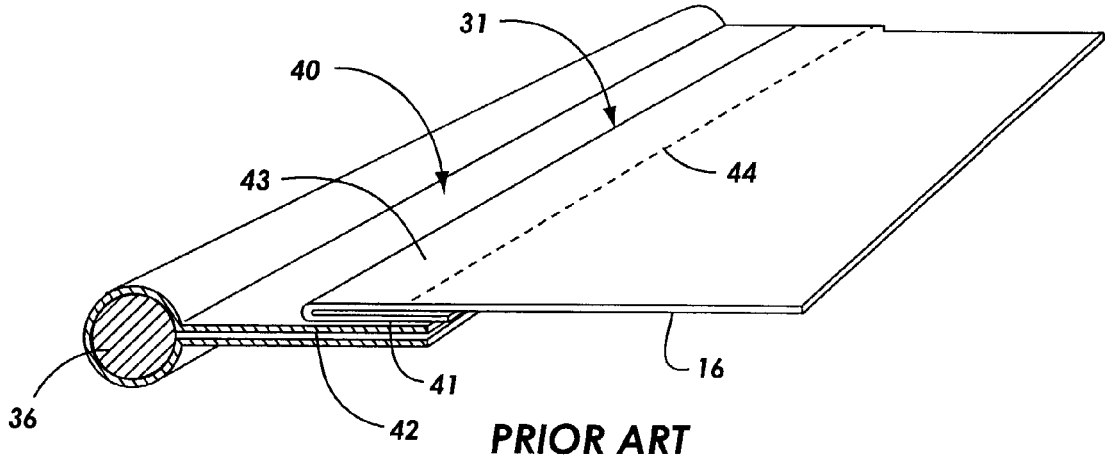
FIG. 3 is a perspective view of a prior art structure including an edge of a pool cover sewn to a webbing and bead for attaching to the tracking assembly of FIG. 2.
Figure 4:
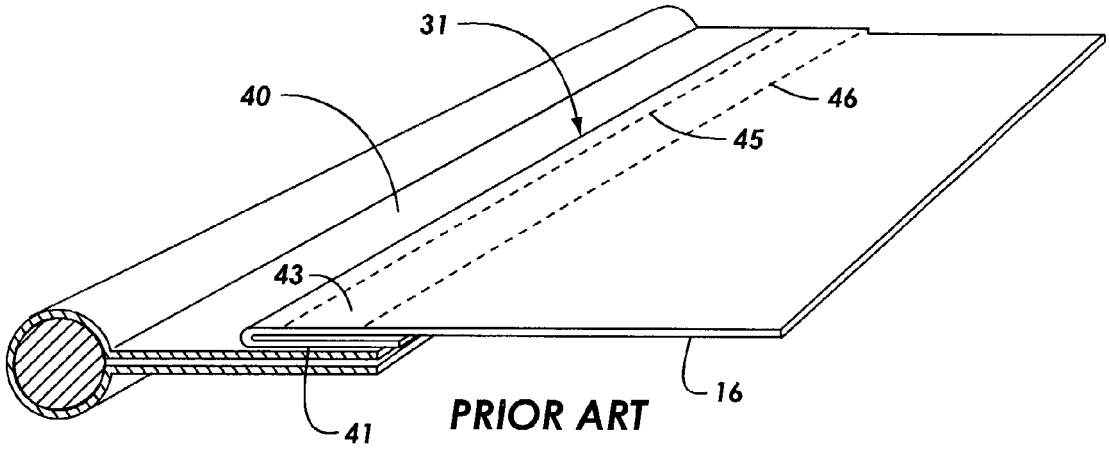
FIG. 4 is a perspective view of another prior art structure including an edge of a pool cover sewn to webbing and bead for attaching to the tracking assembly of FIG. 2.

In FIGS. 3 and 4, prior art methods are shown, wherein bead 36 is formed by wrapping an elongated webbing member 40 around rope 36 and attaching it to pool cover 16. The webbing member 40 is wrapped around the rope 36 and then sewn to the edge 31 of the pool cover 16.

In FIG. 3, a first fold portion 41 is formed along the edge 31 of the pool cover 16 and then sewn onto the webbing 40, using a line of thread stitching 42. A second fold portion 43 is formed over the top of portion 41 and a second line of thread stitching 44 is added to secure the second fold portion 43 to the webbing 40. This approach requires two sewing passes but protects one of the threads from sunlight. In FIG. 4, first and second fold portions 41 and 43 are formed first and then sewn with two stitch lines 45 and 46 providing a double stitching through both folds in one pass, but exposing both lines of stitching to the sunlight.

As previously mentioned, the pool cover 16 may be fabricated from a vinyl-coated mesh made up of a dacron thread or "skrim" covered on top and bottom by vinyl coating. The result is a strong, durable and waterproof material that is ideal for long-term, maintenance-free use. The webbing may be made out of canvas or sail cloth, so that it can endure the mechanical stresses and wear placed on it as the bead 36 slides along the encapsulation assembly 30 and as weight is placed on the cover 16.

The thread stitches 45 and 46 or 42 and 44 are vulnerable to extensive wear. Although very strong and durable thread is used and multiple stitch lines are applied, the thread may eventually wear out before the cover or the webbing. This wear occurs as the result of several factors, including ultraviolet rays from sunlight, chemical corrosion from pool chemicals and the mechanical stresses described above. Accordingly, it is not unusual for periodic repairs to be required to the thread stitching in order to maintain the integrity of the connection between the webbing and the pool cover.

Figure 5A:
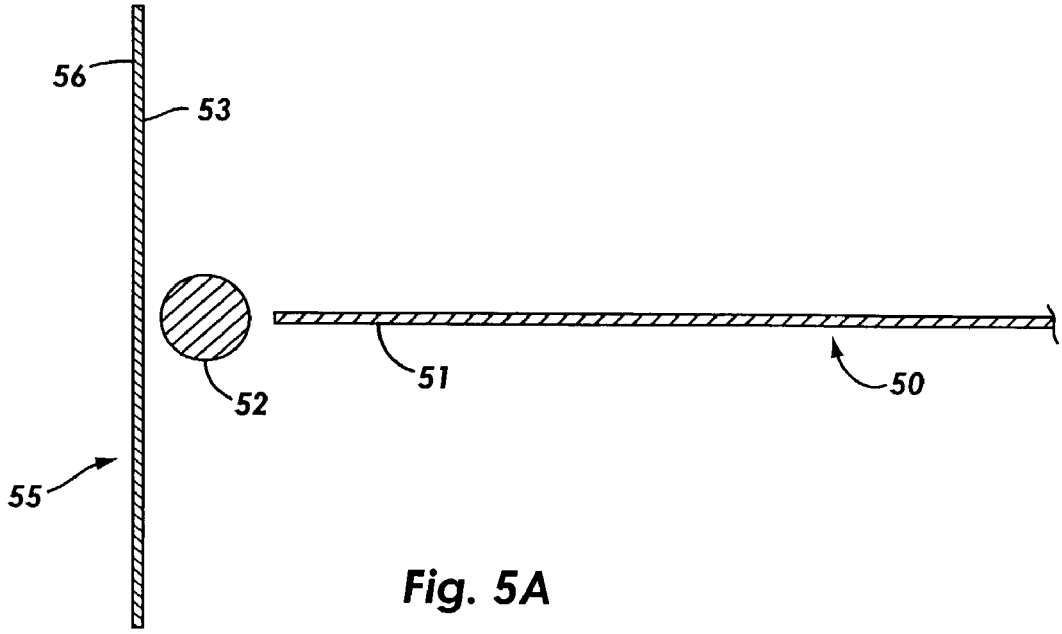
FIGS. 5A–C are schematic views showing the steps involved in fabricating a webbing structure.
Figure 5B:
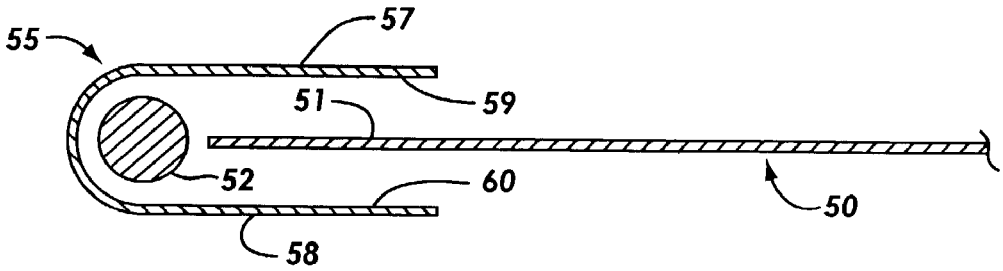
Figure 5C:
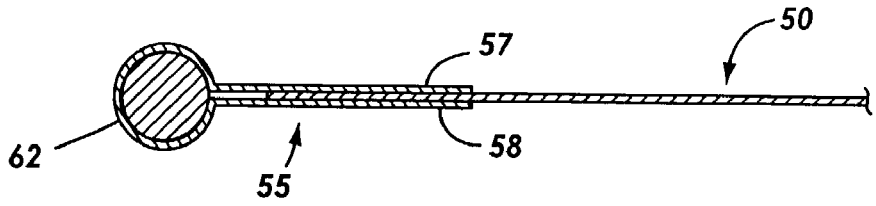

Looking now at FIGS. 5A–C, a preferred application of the method of the present disclosure is shown. As shown in FIG. 5A, in a first step, a pool cover 50 includes a pool cover edge 51 disposed adjacent to an elongated rope or filler member 52. A webbing member 55 is disposed on the other side of the rope member 52. Preferably the pool cover 50 is composed of a mesh made up of a dacron thread or "skrim" covered on top and bottom by vinyl coating. The webbing member 55 is composed of an extremely strong and durable fabric mesh having one side 53 coated by vinyl and the other side 56 not coated by vinyl.

As shown in FIG. 5B, in a second step, an appropriate mechanism (not shown) folds webbing member 55 over filler member 52 to form upper and lower flaps 57 and 58 extending above and below pool cover edge 51. The surfaces 59 and 60 of flaps 57 and 58, respectively, that are adjacent to pool cover edge 51 are part of the vinyl-coated surface 53 and extend over the vinyl-coated pool cover edge 51.

FIG. 5C shows a third step, wherein upper and lower flaps 57 and 58 are formed around filler member 52 to form bead 62. Flaps 57 and 58 are rolled flush with pool cover edge 51. Heat and pressure are applied to form a heat weld or seal 55 comprised of bonded flaps 57 and 58 bonded on either side of pool cover edge 51.

Figure 6A:
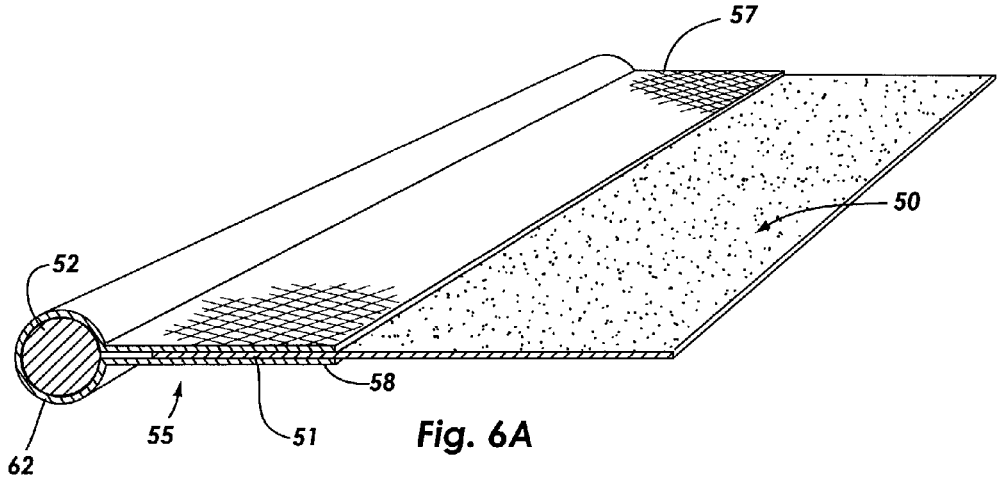
FIG. 6A is a perspective view showing the webbing structure connected to an edge of the pool cover.

FIG. 6A shows a perspective view of the heat sealed webbing 55 and pool cover edge 51 according to the present disclosure. Bead 62 is formed by wrapping webbing 55 around the rope or filler element 52. Flaps 57 and 58 are heat sealed to the pool cover edge 51 to form a strong, durable heat seal between the flaps 57 and 58 of the webbing 55 and the pool cover 50.

Figure 6B:
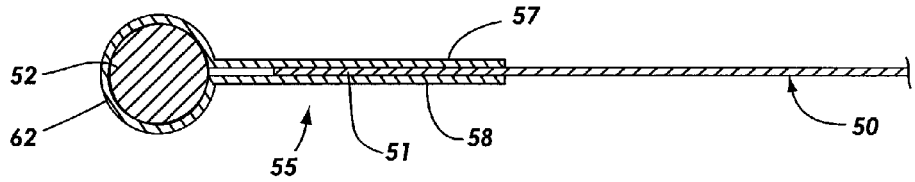
FIG. 6B is a side view of the webbing structure shown in FIG. 6A.

FIG. 6B shows a side view of the structure shown in FIG. 6A. Preferably, the bead 62 formed by the elongated filler element 52 and the webbing 55 are impervious to wear along the track assembly 30, shown in FIG. 2, and the filler element 52 is composed of a material that substantially maintains its shape when mechanical stress and tension is applied. Thus, as shown in FIG. 2, the bead 36 can slide in chamber 32 along the encapsulated track 30 without risk that the bead will deform and be pulled out of the slot 38 in chamber 32 by transverse forces acting on pool cover 16.

Figure 7A:
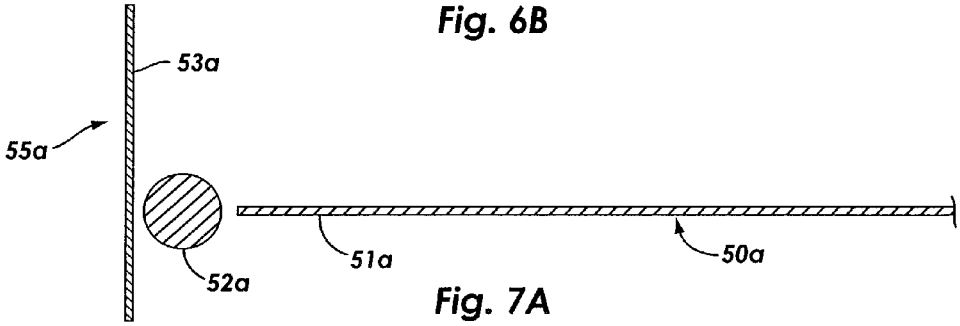
FIGS. 7A and 7B are side views of another implementation showing a webbing structure connected to an edge of the pool cover.

FIG. 7A shows an alternative implementation of the present disclosure wherein a webbing is attached to only one side of a pool cover by heat sealing. A webbing member 55*a* and a filler member 52*a* are disposed adjacent to the edge 51*a* of a pool cover 50*a*. Webbing member 55*a* has at least one side 53*a* that has a surface of vinyl or other thermoactive material.

Figure 7B:
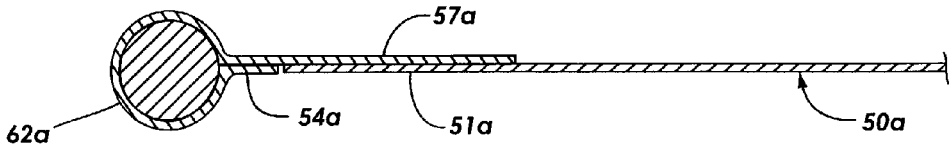

As shown in FIGS. 7A–B, webbing member 55*a* is wrapped around filler member 52*a* to form a bead 62*a*. The top portion of webbing 55*a* forms a flap 57*a* lying in contact with the top surface of pool cover edge 51*a*. The bottom portion 54*a* of webbing 55*a* is disposed in contact with the undersurface 53*a* of webbing member 50*a*. The adjoining surfaces of 54*a* and 55*a* may be connected together by heat sealing, stitching or other procedure sufficient to secure 54*a* to the portion of flap 57*a* as shown. The adjoining surfaces of flap 57*a* and pool cover edge 51*a* are connected together by heat sealing, using a procedure substantially the same as previously described with respect to FIGS. 5A–5C and 6A–6B.

One advantage to the implementation disclosed in FIGS. 7A and 7B is that only a single heat seal need be formed between two adjoining surfaces. This approach will be effective if the single heat seal is strong enough to withstand the wear and stress applied to the pool cover and webbing.

Figure 8:
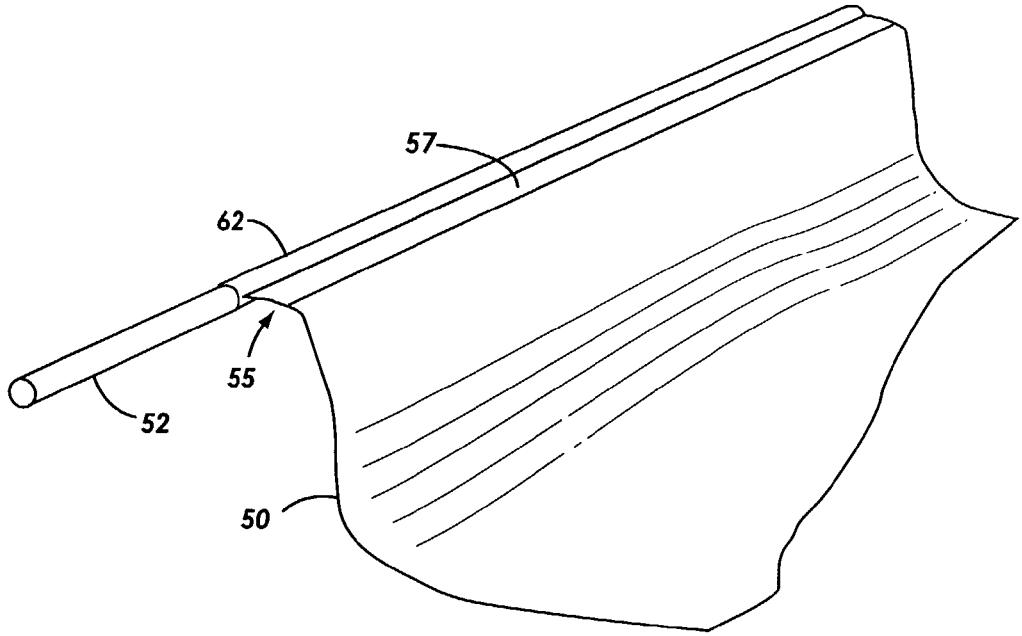
FIG. 8 is another perspective view showing the webbing structure of FIG. 6A.
Figure 9:
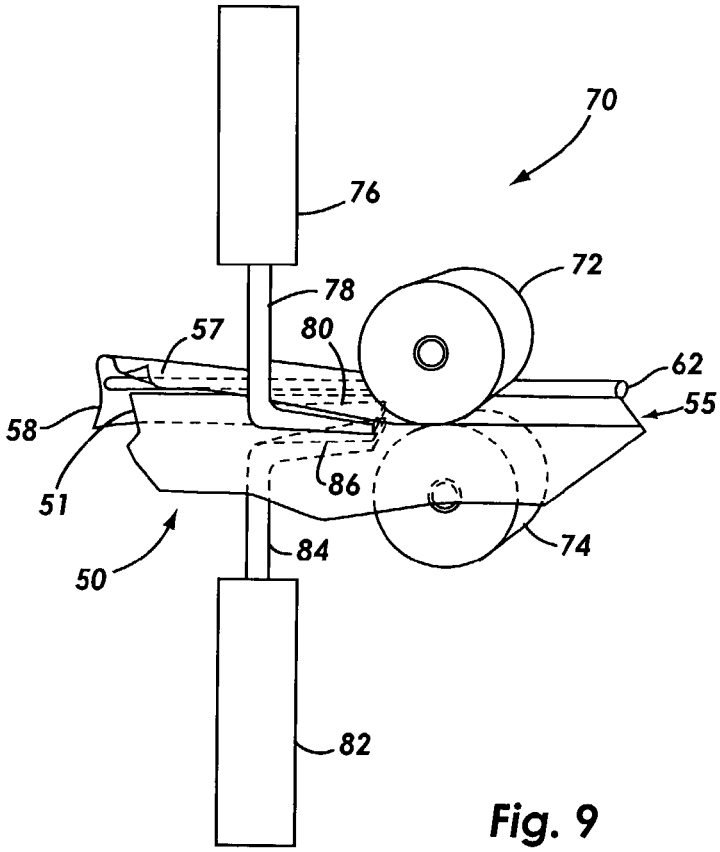
FIG. 9 is a schematic view of an apparatus for forming the webbing structure.

FIG. 8 is another view showing pool cover 50 attached to the heat sealed webbing 55 with a beaded edging 62. Flap 57 of webbing member 55 is securely heat sealed to pool cover 50. Filler element 52 is preferably a ¼ inch woven rope, but could be made of a dacron vinyl thread or any other durable material that will hold its shape when subjected to mechanical stress and tension.

Figure 11:
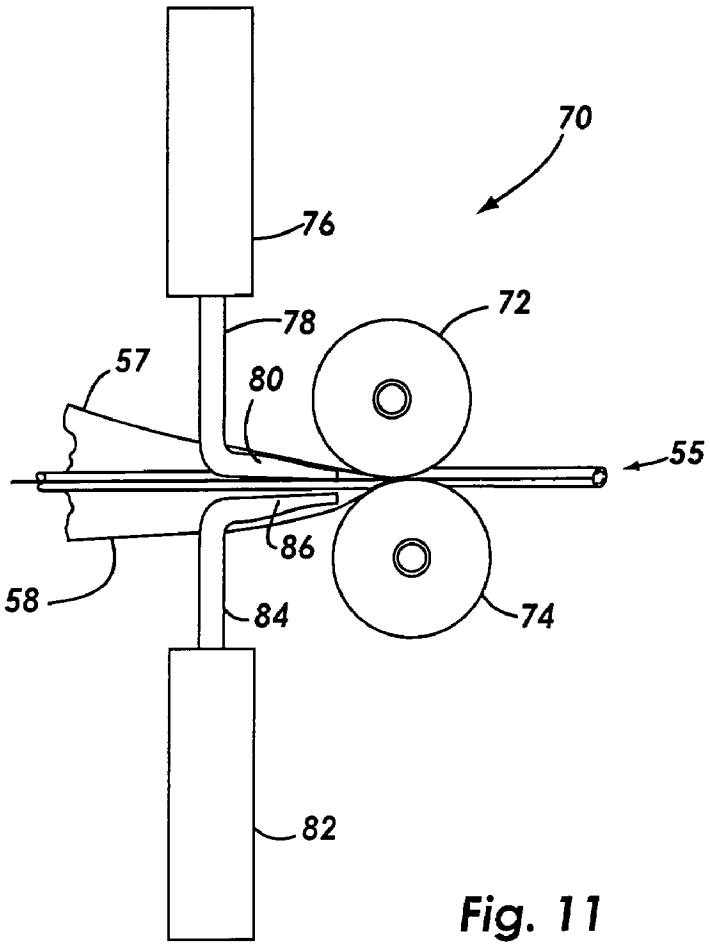
FIGS. 10 and 11 are side views of the apparatus of FIG. 9.
Figure 10:
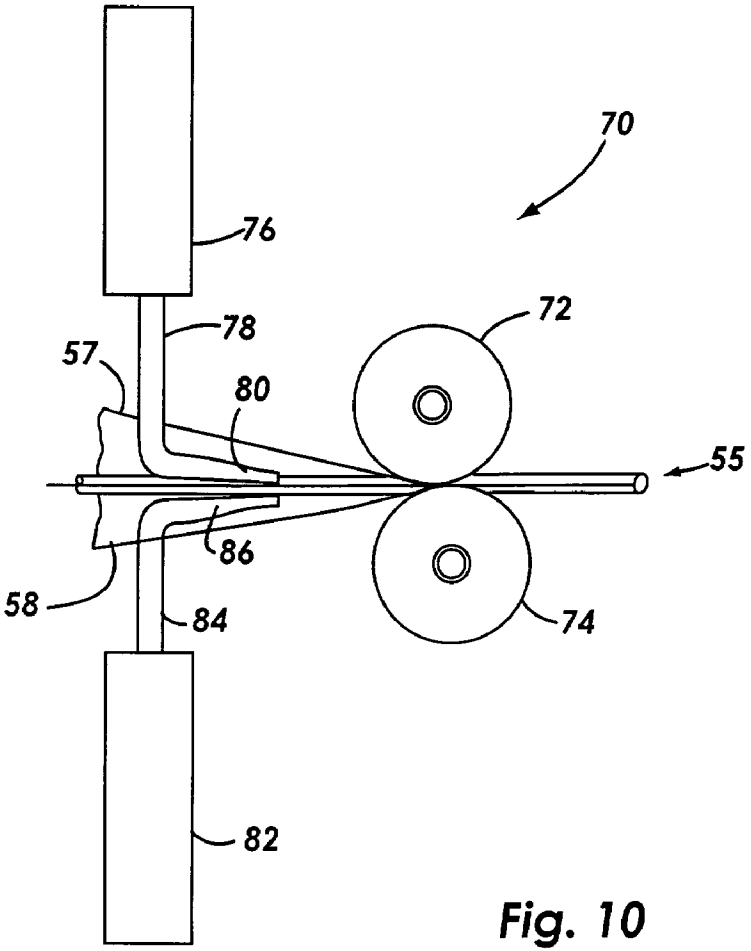
Figure 12:
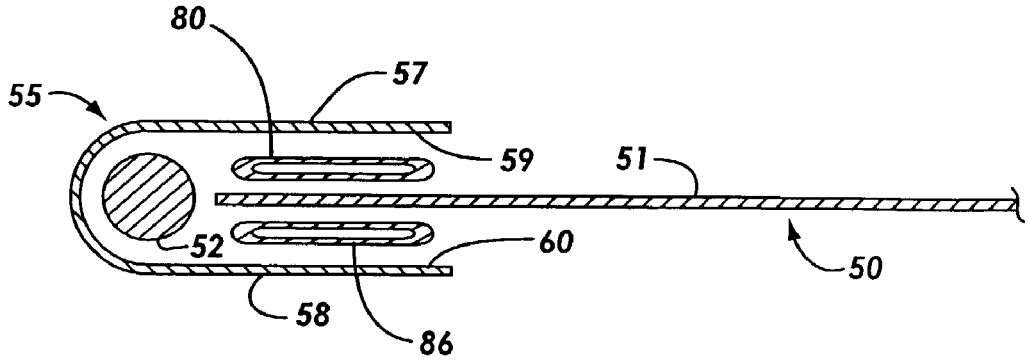
FIG. 12 is a cross-section partial view of the side views of FIGS. 10 and 11.

FIGS. 9–15 show one implementation of an apparatus 70 used to form the heat sealed web element 55. As best seen in FIGS. 10–12, flaps 57 and 58 are wrapped around filler element 52 and extended adjacent to the pool cover edge 51. An upper heater element 76 forces hot air through nozzle 78 and out of nozzle spout 80. Spout 80 rides between upper flap 57 and the upper surface of pool cover edge 51 to apply heat to both surfaces. Similarly, a lower heater element 82 forces hot air through a nozzle 84 and out of nozzle spout 86 between lower flap 58 and the under surface of pool cover edge 51.

Looking particularly at FIG. 12, the hot air partially melts the adjoining surfaces of the pool cover edge 51 and the inside surfaces 59 and 60, respectively, (shown in FIG. 5B) of upper flap 57 and lower flap 58, respectively, so that these surfaces can form heat welded connections. As seen in FIGS. 10 and 11, upper roller 72 and lower roller 74 press flaps 57 and 58 against pool cover edge 51 while said surfaces are heated to form secure heat seals between the surfaces, so that the web element 55 is firmly attached to the pool cover edge 51.

The hot air generated by heater elements 76 and 82 may be heated to a temperature between approximately 1000–1300 degrees Fahrenheit. Fifty pounds or more of pressure may be applied by the rollers 72 and 74 to the heated flaps 57 and 58. The result is an extremely strong heat weld or seam in the heat sealed web element 55 that will withstand forces that might be expected to be applied to the pool cover 50. The heat seal is not susceptible to deterioration from the sunlight or from chemical erosion. Methods of constructing such an apparatus are well known to those of skill in the art.

Moreover, the heat sealed web structure 55 above and below the pool cover edge 51, as described above, is formed in one pass of the materials through the apparatus. Heat is applied to the webbing flaps 57 and 58 at substantially the same time, and the rollers 72 and 82 confirm the heat seals to complete the sealing operation. This one pass procedure minimizes the amount of labor required to form the heat sealed webbing.

In operation, an operator may feed the webbing member 55 and the pool cover 50 to mate with each other, as further shown in FIGS. 10–12 and as described above. The apparatus may be manned by one person feeding the bead 52, the webbing member 55, and the pool cover edge 51 between rollers 72 and 74. Accordingly, the entire structure may be quickly and efficiently formed along the edge of a pool cover 50.

Figure 13:
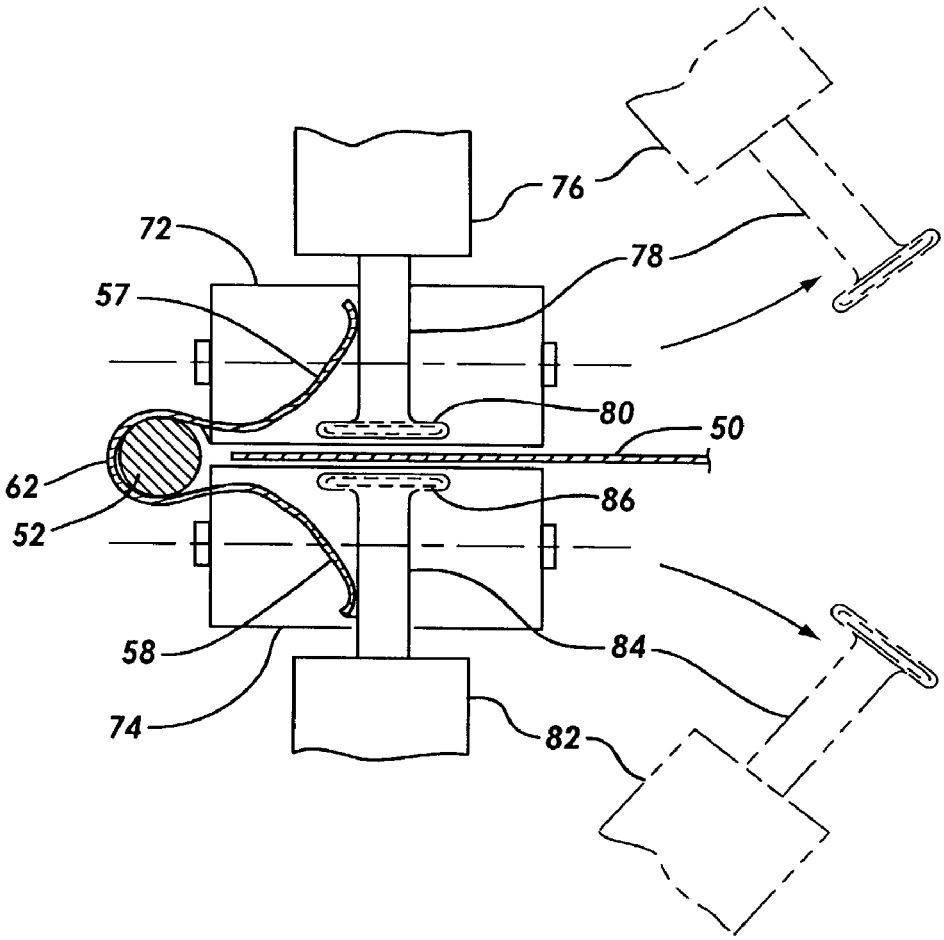
FIG. 13 is a side view of the apparatus of FIG. 9 with part of the apparatus rotated.
Figure 14:
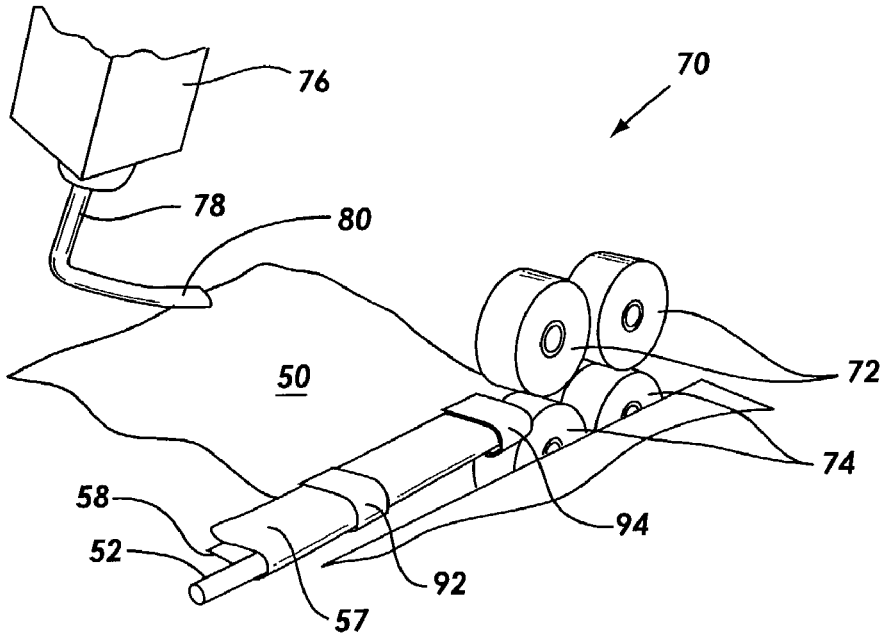
FIG. 14 is a perspective view of the apparatus of FIG. 9 with part of the apparatus rotated.

Referring now to FIGS. 13 and 14, it can be seen that the nozzles 78 and 84 may be rotated away from the rollers 72 and 74 when the apparatus is not in use. This action makes it easier to set up the apparatus for operation and to clean the apparatus. When the apparatus is ready for operation, the nozzles 78 and 84 are rotated back into an aligned position, as best seen in FIG. 10. Then nozzles 78 and 84 are slid forward toward the rollers 72 and 74 until they are in close proximity therewith, as best seen in FIG. 11.

Figure 15:
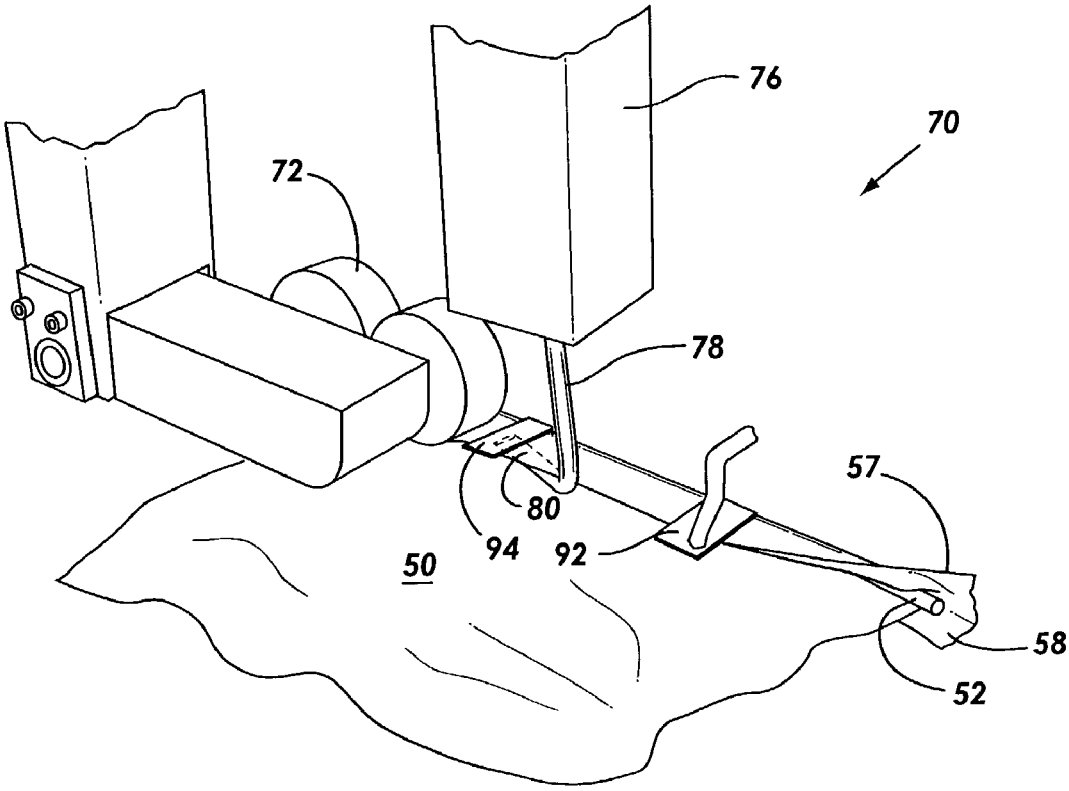
FIG. 15 is another perspective view of the apparatus of FIG. 9 with the apparatus in operation.

FIG. 15 is another perspective view showing the apparatus 70 in operation. Heater element 76 and nozzle 78 have been rotated into alignment with roller 72. Nozzle 78 is twisted slightly so that nozzle spout 80 will slip beneath webbing flap 57 without nozzle 78 interfering. A first guide member 92 guides flap 57 toward the roller 72. A second guide 94 directly in front of roller 72 maintains a slight separation between flap 57 and the edge 51 of pool cover 50. This separation provides a space for nozzle spout 80 to inject hot air into the space to partially melt the vinyl undersurface of flap 57 and the top surface of pool cover edge 51, as previously shown in FIGS. 10–12.

An substantially identical operation occurs on the underside of apparatus 70. Although not shown, heater element 82 and nozzle 84, seen in FIGS. 10, 11 and 13, have also been rotated in alignment with roller 74. Guides (not shown) similar to guides 92 and 94 direct the webbing 55 to roller 74, maintaining a space for nozzle spout 86 to inject heated air to partially melt the appropriate surfaces just prior to roller 74 applying pressure to confirm the heat seal between the top surface 60 of flap 58 and the under surface of pool cover edge 51.

It is understood that variations of the above preferred implementation might be employed within the scope of the disclosure. For example, in some cases the hot air coming from nozzle foot 80 and nozzle foot 86 may provide too much heat to the flaps 57 and 58 and the pool cover edge 51. In such case the upper or lower mechanisms may be offset by a a sufficient distance (not shown) to allow cooling of the flaps 57 and 58 and pool cover edge 51 between applications of hot air from the nozzle feet 80 and 86.

Thus, the upper mechanisms, including roller 72, heater element 76, nozzle 78 and nozzle foot 80 might be offset longitudinally along the service line of the pool cover edge 51 by some distance from the lower roller 76, heater element 82, nozzle 84 and nozzle foot 86. In the interim space, cool air may be applied to the flaps 57 and 58 and the pool cover edge 51 to allow the bond between the lower flap 58 and the pool cover edge 51 to cool and bond. Conversely, the hot air could be applied first to the upper flap and pool cover edge 51 and then the lower flap 58 and pool cover edge 51 could be bonded further down the service line of the pool cover edge.

Although the above applications are representative of the present disclosure, other applications will be apparent to those skilled in the art from a consideration of this specification and the appended claims, or from a practice of the applications of the disclosure. It is intended that the specification and applications therein be considered as exemplary only, with the present disclosure being defined by the claims and their equivalents.

What is claimed is:

1. A method for attaching an elongated webbing member to an edge of a pool cover, comprising:

positioning the edge of the pool cover so that a portion of the pool cover edge is adjacent to a portion of an elongated filler member, wrapping a portion of the elongated webbing member around the portion of the elongated filler member to form an elongated bead such that the elongated webbing member forms a top flap extending from a top portion of the elongated filler member and a bottom flap extending from a bottom portion of the elongated filler member, the pool cover edge being positioned at least partially between the top flap and the bottom flap, and heat sealing the webbing portion to the pool cover edge portion.

2. The method of claim 1 wherein the heat sealing step is performed by applying hot air to the webbing portion and the pool cover edge portion.

3. The method of claim 1 wherein the heat sealing step includes heating the webbing portion and the pool cover edge portion and applying pressure to the webbing portion and the pool cover portion.

4. The method of claim 1 wherein the webbing portion is folded over the pool cover edge portion and heat is applied to the webbing portion and the pool cover edge portion.

5. The method of claim 4 wherein heat is applied to the top flap of the webbing portion adjacent to an upper surface of the pool cover edge portion, and heat is applied to the bottom flap of the webbing portion adjacent to a lower surface of the pool cover edge portion.

6. The method of claim 5 wherein heat is also applied to said upper and lower surfaces of the pool cover edge portion.

7. The method of claim 5, wherein heat is applied to the top flap and the bottom flap of the webbing at substantially same time, so as to form an upper heat weld and a lower heat weld between the webbing portion and the pool cover edge portion in one pass along the pool cover.

8. The method of 5, wherein pressure is applied to the webbing portion immediately after heat is applied thereto.

9. The method of claim 1, wherein the top and bottom flaps are heat sealed to the pool cover edge portion on opposing surfaces of the pool cover edge portion.

10. The method of claim 9 wherein the top and bottom flaps of the webbing portion are heat sealed to the pool cover edge portion by application of hot air to the webbing portion and to the pool cover edge portion.

11. The method of claim 10 further comprising applying pressure to the webbing portion.

12. The method of claim 9, wherein the top and bottom flaps are both heat sealed to the pool cover edge on one pass over the pool cover edge.

13. The method of claim 1, wherein the portion of the pool cover and the portion of the webbing that are in contact with each further comprise a thermoactive material.

14. The method of claim 13, wherein the heat sealing step is performed by applying heat to the portion of the pool cover and the portion of the webbing to cause bonding between the pool cover portion and the webbing portion.

15. The method of claim 1, wherein the webbing portion is disposed in contact with two sides of the pool cover edge portion, and the heat sealing step comprises sealing the webbing portion to said two sides of the pool cover edge portion.

16. The method of claim 15, wherein the adjoining surfaces of the webbing portion and the pool cover edge portion form a first heat weld and a second heat weld between the webbing portion and the pool cover edge portion.

17. The method of claim 1, wherein said heat sealing step includes applying heat to the top flap and the bottom flap of the webbing portion, as well as to an upper surface and a lower surface of the pool cover edge portion at substantially the same time.

18. A method for attaching an elongated webbing member to an edge of a pool cover, comprising:

positioning the edge of the pool cover so that a portion of the pool cover edge is positioned at least partially between a first flap and a second flap of the elongated webbing member, heat sealing the first flap of the webbing portion to a top surface of the pool cover edge portion, wherein heated air is applied to the first flap and the top surface of the pool cover edge portion, and heat sealing the second flap of the webbing portion to a bottom surface of the pool cover edge portion, wherein heated air is applied to the second flap and the bottom surface of the pool cover edge portion at approximately the same time that heated air is applied to the first flap and the top surface of the pool cover edge portion.

19. The method of claim 18 wherein heated air heated air is applied to the first flap, the second flap, the top surface of the pool cover edge portion, and the bottom surface of the pool cover edge portion in a single pass.

20. The method of claim 18 further comprising applying pressure to at least the portion of the webbing that is in contact with the portion of the pool cover edge.

21. A method for attaching an elongated webbing member to an edge of a pool cover, comprising:

positioning the edge of the pool cover so that a portion of the pool cover edge is in contact with a portion of the webbing, the pool cover edge portion comprising top and bottom surfaces, the webbing portion comprising a first flap and a second flap, and heat sealing the first flap of the webbing portion to the top surface of the pool cover edge portion and the second flap of the webbing portion to the bottom surface of the pool cover edge portion at substantially the same time.

22. The method of claim 21 further comprising applying pressure to the webbing portion during the heat sealing step.

23. The method of claim 21, where said heat sealing step includes applying heated air to the first flap and the second flap of the webbing portion, as well as to the top surface and the bottom surface of the pool cover edge portion, at substantially the same time.

* * * * *

UNITED STATES PATENT AND TRADEMARK OFFICE

CERTIFICATE OF CORRECTION

PATENT NO. : 6,991,700 B2
DATED : January 31, 2006
INVENTOR(S) : Lanny R. Smith

It is certified that error appears in the above-identified patent and that said Letters Patent is hereby corrected as shown below:

Column 7,
Lines 40-41, change "top flap and the bottom flap of the webbing at substantially same" to -- top flap and the bottom flap of the webbing at substantially the same --.

Column 8,
Lines 35-36, change "The method of claim 18 wherein heated air heated air is applied" to -- The method of claim 18 wherein heated air is applied --.

Signed and Sealed this

Twenty-eighth Day of March, 2006

JON W. DUDAS
*Director of the United States Patent and Trademark Office*